United States Patent [19]

Goldfarb et al.

[11] 4,021,041

[45] May 3, 1977

[54] THROW AND CATCH TOY

[75] Inventors: Adolph E. Goldfarb, Tarzana; Erwin Benkoe, Encino; Delmar K. Everitt, Woodland Hills; Ronald F. Chesley, La Crescenta; Richard D. Frierdich, Canoga Park, all of Calif.

[73] Assignees: Adolph E. Goldfarb; Erwin Benkoe, both of Northridge, Calif.

[22] Filed: Sept. 12, 1975

[21] Appl. No.: 612,954

[52] U.S. Cl. ..... 273/106.5 R; 273/106 R; 273/106.5 C

[51] Int. Cl.[2] ..... A63B 65/00

[58] Field of Search .... 273/106 R, 106 D, 106.5 R, 273/106.5 B, 106.5 C

[56] References Cited

UNITED STATES PATENTS

| | | | |
|---|---|---|---|
| 2,035,629 | 3/1936 | Wing | 273/106 D |
| 2,193,397 | 3/1940 | Dykes | 273/106.5 C |
| 3,216,727 | 11/1965 | Hunter | 273/106.5 R X |
| 3,393,912 | 7/1968 | DeLonais | 273/106.5 R |
| 3,539,187 | 11/1970 | Smith | 273/106.5 C |
| 3,746,334 | 7/1973 | Stubblefield | 273/106 R X |
| 3,881,730 | 5/1975 | Carella | 273/106.5 B |

*Primary Examiner*—Paul E. Shapiro
*Attorney, Agent, or Firm*—Robert M. Ashen; Robert J. Schaap

[57] ABSTRACT

A projectile toy which may be thrown by a first player and caught by a second receiving player. The toy is designed to follow a generally horizontal stable flight path and to glide in a generally horizontal orientation, particularly through the latter portion of its flight to facilitate being caught by the receiving player. The toy includes an elongated shaft, a set of front fins mounted at the forward end of the shaft, and a set of rear fins mounted at the rear end of the shaft. Both sets of fins are circumferentially spaced around the shaft and extend outwardly therefrom. The fins are made of a readily deformable plastic material which tends to retain its deformed shape upon removal of deforming forces. The toy is of lightweight construction, particularly with reference to its weight versus fin area ratio.

11 Claims, 6 Drawing Figures

THROW AND CATCH TOY

Toys which may be thrown by one player and caught by another player have taken a variety of forms. Broadly, such toys include balls of various shapes. Toys which provide a gliding feature include the disc-like toys sold under the trademark "Frizbee." Such disc-like toys tend to be difficult to control in their flight and require the development of a good deal of skill to avoid the disc veering off upwardly or downwardly or to the side. They are also somewhat difficult to catch, particularly when they are thrown at high speed. This is particularly true for smaller children.

The toy of the present invention contemplates generally an elongated shaft having a set of fins at its forward end and a set of fins at its rearward end. This toy is disposed with the shaft generally horizontal, is grasped by the first throwing player at an intermediate portion of the shaft between the forward and rearward fins, and is thrown somewhat like a javalin with the shaft disposed horizontally and proceeding forwardly along a generally horizontal flight path. The fins tend to maintain the toy in such a horizontal flight path and further cause it to glide, particularly through the latter portion of the flight, to facilitate the toy being grasped by the receiving player at an intermediate portion of the shaft. In one aspect, the fins may be formed with angled portions that impart a rotation about the shaft axis to the toy as it moves forwardly through its flight. This tends to compensate for any variations in the weight and/or structure of the toy around the shaft axis, to facilitate the stable and generally horizontal flight pattern, and to reduce any tendency for the toy to veer off from the direction in which it is thrown. Such angled portions of the fins may be provided by selectively adjustable fin sections. In one form, the entire fin may be of a deformable material such as polyethylene foam which may be deformed to the desired configuration and tends to remain in such configuration.

It is also desirable that the toy be relatively lightweight to achieve its gliding or floating characteristic. In this regard, the ratio of the weight of the toy to the effective fin area should be relatively low.

IN THE DRAWINGS

Figure 1:
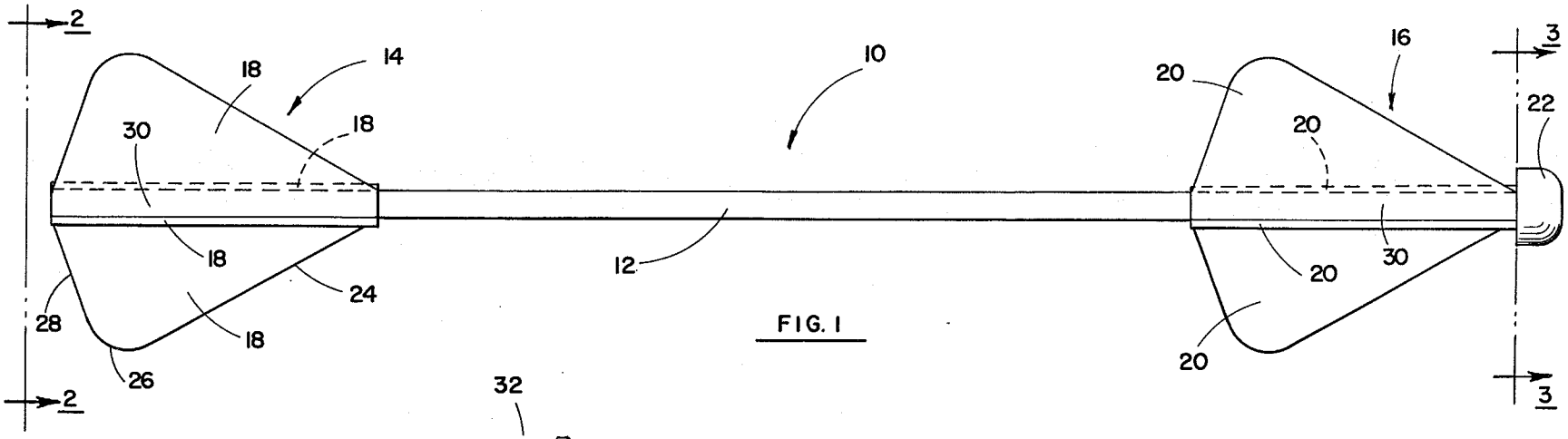
FIG. 1 is a side view of a projectile toy which comprises a presently preferred embodiment of the invention.

In general, the illustrated toy 10 comprises an elongated shaft 12, having a longitudinal axis XX, a rear end portion 14, and a front end portion 16. A set of rear fins 18 are mounted on the rear portion 14 of the shaft and a set of front fins 20 are mounted on the front portion 16 of the shaft. The illustrated fins 18 and 20 are equally spaced around the periphery of the shaft and extend radially outwardly therefrom. A front end bumber or element 22 is provided at the front end of the shaft 12 to cushion the impact of the toy against objects or people which it may strike.

Figure 3:
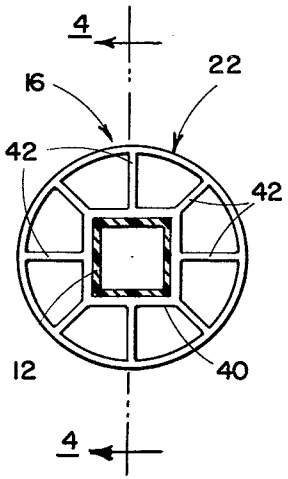
FIG. 3 is a transverse sectional view, further enlarged, taken generally along line 3—3 of FIG. 1.
Figure 4:
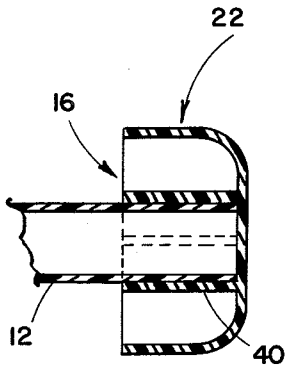
FIG. 4 is a sectional view taken generally along line 4—4 of FIG. 3.
Figure 2:
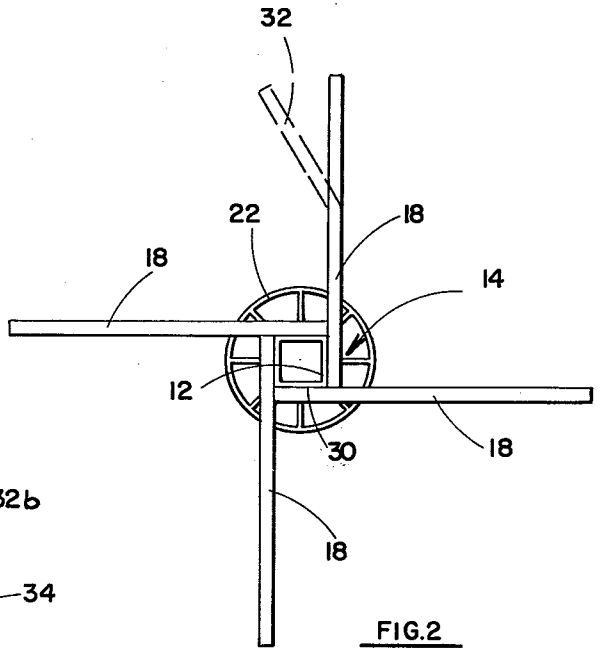
FIG. 2 is an enlarged rear end view of the toy of FIG. 1 taken generally along line 2—2 of FIG. 1.

More particularly, the elongated shaft 12 is preferrably of lightweight low density construction. As an example, it may be extruded styrene. The illustrated shaft 12 is hollow and has a generally square cross-sectional configuration as shown in FIGS. 2 and 3. The shaft may be of a rigid or semi-rigid material capable of essentially retaining its shape during use. In one form, the shaft has a length of 29 inches and a cross-section of ½ inch across each side of its square.

The fins are secured to the respective end portions of the shaft by adhesive or other suitable means. The fins are also of relatively light weight material such as polyethylene foam. Each of the illustrated fins has a leading edge 24 which extends rearwardly and outwardly at an angle of approximately 30° from the axis of the shaft. The leading edge 24 then merges into a curved section 26 which in turn merges into a rear edge 28 which is disposed slightly forwardly at an angle of approximately 70° from the shaft axis. The fins may be relatively thin. In one form, each fin has a thickness of about ⅛ inch, an overall length of about 6¼ inches, a leading edge of approximately 5¼ inches and a rear edge of approximately 2¼ inches, with the overall length of the shaft being 29 inches.

The illustrated toy 10 has four fins at the front end and four fins at the rear end, the fins being arranged equally distant from one another to define a 90° angle between adjacent fins, as shown in FIG. 2. Each of the fins includes a base portion 30 which is secured against the exterior of one of the sides of the shaft 12. In this way, the four illustrated fins 18 are mounted around the square shaft configuration at the rear portion 14 as shown in FIG. 2. The front fins 20 are similarly mounted at the front end portion 16 of the toy. If desired, more than four fins could be provided at the front end or rear of the toy, and it would also be possible to reduce the number of fins to three, if desired. The illustrated fins at front and rear are aligned with one another by virtue of their securement to the square shaft; however, such alignment of rear and front fins would not appear to be necessary.

Provision of fins at both front and rear ends of the shaft is an important feature of the present device. The provision of fins both front and rear provides the gliding boyant lifting affect at both ends of the shaft and facilitates generally level horizontal flight of the toy when it is propelled. The ability to maintain this horizontal orientation during flight is a desired feature of the present invention and contributes greatly to the ease and ability to grasp the device by the receiving player at a furthermost portion of the flight path of the device.

Figure 5:
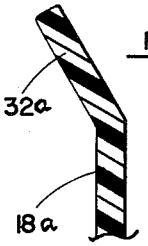
FIG. 5 is a schematic section of a portion of a fin showing a preformed angled section.
Figure 6:
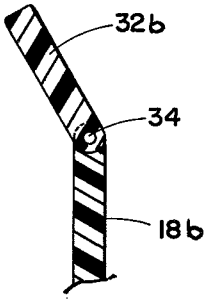
FIG. 6 is a schematic section of a portion of a fin showing an adjustable angled section.

An added feature of the illustrated toy 10 is the provision of means which impart rotational movement about the shaft axis to the toy as it moves forwardly in the direction of the shaft axis. The means provided in the illustrated toy 10 for imparting this rotation comprise forming the radially outward end portions 32 of the fins at an angle to the remaining portion of the fin. Such an angled portion 32 of one fin is illustrated in broken line FIG. 2. Providing the fins with such angled portions 32 imparts the desired rotation to the toy during its flight. The illustrated fins are of a polyethylene foam which may be manually deformed in the way illustrated in FIG. 2 by the broken line showing of section 32. Such foam material tends to remain in a deformed position and yet may be further deformed or may be returned to other desired positions. Alternatively, the fins 18*a* may be of a rigid or semi-rigid material and may be pre-formed with end portions or sections 32*a* in the desired offset orientation. (FIG. 5.) As a further alternative, radially outward sections or portions 32*b* may be pivotally connected by hinge means 34 to the remainder of the fin 18*b* for being selectively or adjustably positioned at various angles with respect to the remainder of the fin. (FIG. 6).

The end element or bumper 22 has a rounded exterior knoblike configuration that includes a generally cylindrical side wall 41. The element 22 is provided with a rearwardly opening receptacle section 40 that is generally square in cross-section and proportioned to receive therein the front end of the shaft 12. The shaft may be received in a friction fit or may be glued or otherwise secured to the element 22. The illustrated element 22 is also provided with a plurality of radially extending reinforcing sections 42 which extend between the receptacle section 40 and the generally cylindrical side wall 41 as shown best in FIG. 3. The element 22 is desirably formed of a relatively soft flexible and resilient material such as urethane foam which will absorb shock and be non-injurious to objects or persons that it may strike.

Noted generally above, it is preferable that the toy be relatively lightweight. In one aspect, this may be defined in terms of its weight in relation to its overall fin area. In one example, the overall weight of the toy is 46 grams (1.62 ounces) and the effective area of the fins (excluding base portions 30) comprises 63 square inches for the rear fins and 40 square inches for the front fins, for a total effective fin area of 103 square inches. In this example, there are 2.2 square inches of effective fin area for each gram of weight, or 0.45 grams of weight for each square inch of effective fin area.

Various modifications and changes may be made in the illustrated structure without departing from the spirit and scope of the present invention. For example, as noted above, the number of fins and the particular configuration, size and arrangement of the fins may be modified, the specific materials used may be varied, the cross-sectional configuration, size and length of the shaft may be varied, so long as the device remains capable of generally level stable flight.

We claim:

1. A projectile toy which may be thrown by a first player and caught by a second receiving player, said toy comprising:

an elongated shaft having a longitudinal axis, a forward end portion and a rearward end portion;

a set comprising a plurality of front fins mounted at the forward end portion of the shaft, said fins being circumferentially spaced around said shaft end portion and extending radially outwardly therefrom; and a set comprising a plurality of rear fins mounted at the rearward end portion of the shaft, said fins being circumferentially spaced around said shaft end portion and extending radially outwardly therefrom, said fins being generally disposed in planes that are generally parallel to the longitudinal axis of said shaft, at least the fins of one of said sets each being made of a readily deformable plastic material which tends to retain its deformed shape upon removal of deforming forces such that the fins may be selectively hand shaped by a player so that at least a portion of each such fin spaced radially outwardly from the shaft may be thereby deformed to a plurality of different self-maintaining positions relative to the remaining portion of that fin, with each of said different positions being substantially displaced from the plane of said remaining portion of that fin, said fins being configured and arranged to stabilize the flight path of the toy when it is thrown in a geneally horizontal path and to cause the toy to glide through at least the latter portion of its flight to facilitate it being caught by the receiving player.

2. A toy as set forth in claim 1 having a minimum of three front fins and a minimum of three rear fins.

3. The toy of claim 2 wherein said front fins are equally spaced circumferentially around the shaft and said rear fins are equally spaced circumferentially around the shaft.

4. The toy of claim 1 further comprising means at the front end of said shaft, said means being relatively soft and resilient.

5. The toy of claim 1 wherein said shaft is hollow.

6. The toy of claim 5 wherein said shaft is an extruded plastic tube.

7. The toy of claim 6 wherein said shaft is comprised of a plurality of straight sides.

8. The toy of claim 7 wherein said shaft has four sides forming a rectangular configuration.

9. The toy of claim 7 wherein there are the same number of front fins and the same number of rear fins as there are straight sides to the shaft construction, each of said fins comprising an inward most base portion which is secured to one of the sides of the shaft.

10. The toy of claim 10 wherein said fins are made of a foam plastic material.

11. The toy of claim 10 wherein said shaft is a hollow plastic tube.

* * * * *

UNITED STATES PATENT AND TRADEMARK OFFICE

CERTIFICATE OF CORRECTION

PATENT NO. : 4,021,041

DATED : May 3, 1977

INVENTOR(S) : Adolph E. Goldfarb, et al

It is certified that error appears in the above-identified patent and that said Letters Patent are hereby corrected as shown below:

In Claim 10, at Column 4, line 50, change "claim 10" to

-- Claim 1 --

Signed and Sealed this second Day of August 1977

[SEAL]

*Attest:*

RUTH C. MASON
*Attesting Officer*

C. MARSHALL DANN
*Commissioner of Patents and Trademarks*